United States Patent [19]

Reiter

[11] 4,391,414

[45] Jul. 5, 1983

[54] CONE CRUSHER

[76] Inventor: Rudolf Reiter, Via Fratelli Cervi, 7 - Vimercate (Province of Milan), Italy

[21] Appl. No.: 164,409

[22] Filed: Jun. 30, 1980

[30] Foreign Application Priority Data

Jul. 10, 1979 [IT] Italy ..... 24224 A/79

[51] Int. Cl.[3] ..... B02C 2/06

[52] U.S. Cl. ..... 241/213; 241/215; 241/216

[58] Field of Search ..... 241/37, 290, 286, 207–216

[56] References Cited

U.S. PATENT DOCUMENTS 2,680,571 6/1954 Bjarme ..... 241/215 X
2,878,082 3/1959 Becker ..... 241/209
3,384,312 5/1968 Patterson et al. ..... 241/208
4,192,472 3/1980 Johnson ..... 241/216

*Primary Examiner*—Mark Rosenbaum
*Assistant Examiner*—Timothy V. Eley
*Attorney, Agent, or Firm*—Guido Modiano; Albert Josif

[57] ABSTRACT

A cone crusher for crushing stones comprises an outer shroud housing a shaft driven of conical swinging motion at the middle portion whereof there is provided a crushing or milling cone, cooperating with a shroud conical ring to define an upward widening space therebetween, a rotating bush being provided for housing a hydraulic piston supporting, through an axial roller bearing, the bottom end of the shaft arranged substantially concentrical to the piston.

1 Claim, 3 Drawing Figures

CONE CRUSHER

BACKGROUND OF THE INVENTION

This invention relates to a cone crusher for crushing stones and the like.

As is known, long shaft cone crushers comprise essentially an outer shroud formed of two pieces, namely a bottom shroud and top shroud, which are connected to each other by means of strong bolts which allow the material to flow from top to bottom.

The shroud has mounted internally a suspended or supported shaft which undergoes an eccentric movement at the lower portion thereof, thereby the shaft performs a conical swinging movement.

At a middle portion of the shaft, there is provided a conical part, called the crushing cone, which widens out from top to bottom and is located at a conical milling ring provided on the shroud inside.

The conical milling ring has a smaller taper than the milling or crushing cone, such that the space or clearance between the cone and ring widens towards the top.

Moreover, cone crushers are equipped with devices for raising and lowering the crushing cone with respect to the crushing ring in order to increase or decrease the space separating the cone from the ring and thus throttle the passage area and consequently the size of the resulting product.

The most critical operation of conventional crushers is in fact, and in general, the cone height adjustment, which is accomplished by hydraulic power. More precisely, the shaft carrying the crushing stone floats on a pressurized oil cushion which constitutes the fixed hydraulic raising group, a set of bevel gears being provided within the machine along with a countershaft driving the cam which imparts to the shaft bottom portion the desired eccentric rotation which provides the cited conical swinging movement.

In addition to the above, seating or the like means must be provided for supporting the bottom portion of the shaft and withstand the axial push, which means are unavoidable subjected to a fast wear rate owing to the continuous oscillation of the shaft bottom or lower end.

SUMMARY OF THE INVENTION

This invention sets out to eliminate the problems encountered with conventional crushers by providing a cone crusher which, while retaining the general configuration of conventional cone crushers, has novel features effective to greatly reduce all of the constructional and wear problems normally affecting cone crushers.

Within that general aim, it is possible to arrange that the cone crusher according to this invention makes provision for the utilization of drive belts for the transmission of the rotary motion, which belts are more reliable than the gear drive in this type of application.

It is further possible to arrange that the cone crusher of this invention can successfully withstand the violent shocks which are unavoidably experienced in the crushing or milling chamber on account of the severe and discontinuous loads to which the machine is subjected by the nature of its work.

It is, moreover, possible to arrange that the cone crusher for stones and the like, according to the invention, has a simplified construction, requires no special or complex maintenance procedure, and is highly competitive from an economical standpoint.

According to one aspect of the present invention, there is provided a cone crusher for crushing stones and the like, comprising an outer shroud enclosing a space, a shaft within said space and driven with conical swinging motion, at a middle portion thereof said shaft having a downwardly diverging crushing cone, around said crushing cone on said shroud, a conical ring having a smaller taper than said crushing cone to define an upwardly widening space therebetween, characterized in that the crusher further comprises a bushing arranged to rotate about its own axis and defining with its inside a cavity eccentric with respect to said axis of rotation, a hydraulic piston within said cavity and in sealed relationship therewith, said piston supporting, with the interposition of rolling means, the bottom end of said shaft arranged substantially concentrical to said piston.

BRIEF DESCRIPTION OF THE DRAWINGS

Further features and advantages of the invention will be more readily understood from the following detailed description of a preferred but not limitative embodiment of a cone crusher for stones and the like, with reference to the accompanying illustrative drawings, where.

DESCRIPTION OF THE PREFERRED EMBODIMENTS

Figure 1:
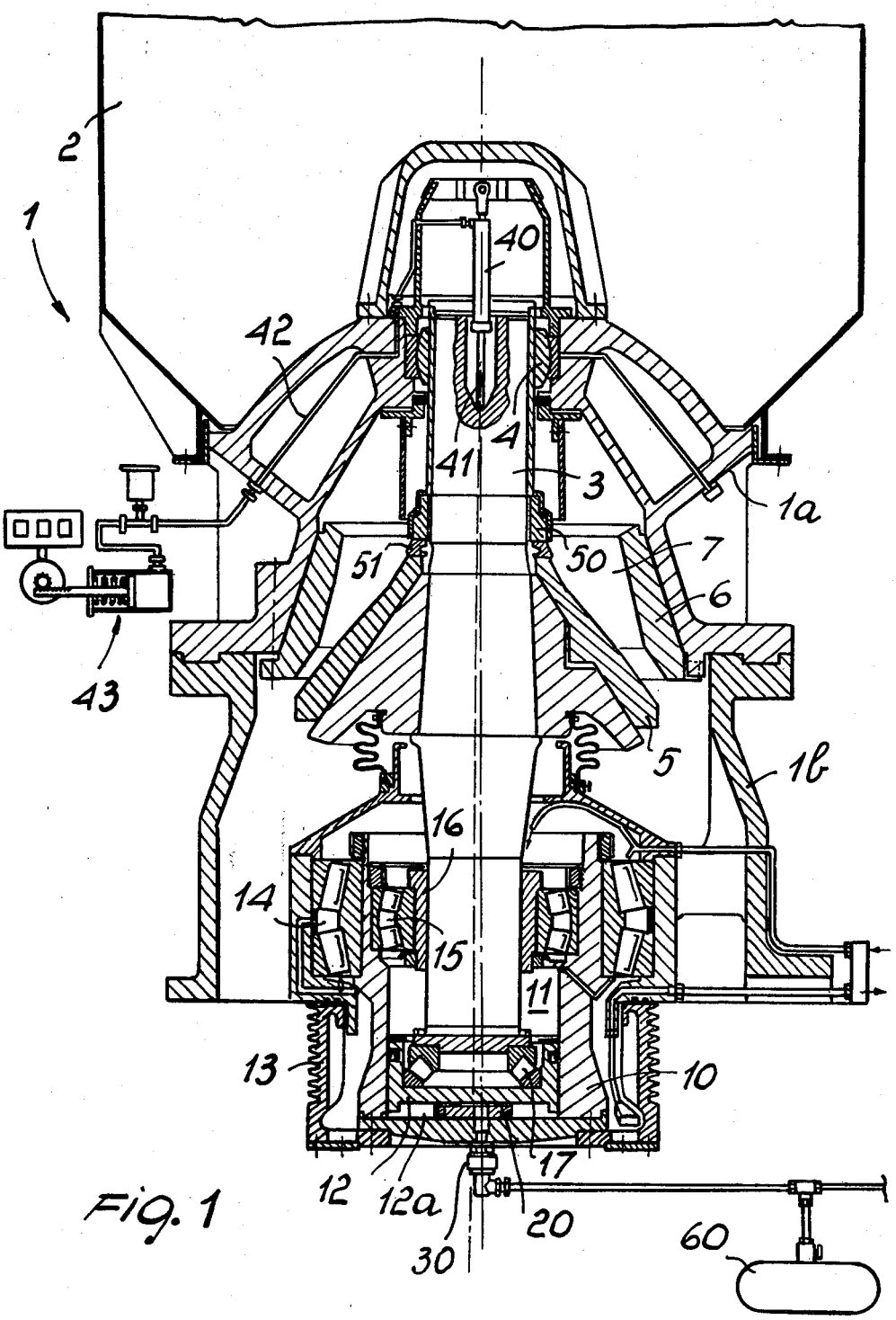
FIG. 1 shows an axial sectional view of the cone crusher according to the invention.

With reference to the cited drawing figures, the cone crusher for crushing stones and the like rocky material, according to this invention, comprises an outer shroud, generally indicated at 1, which is formed from a top or upper part 1*a* and bottom or lower part 1*b*, both parts being held tightly together by a bolted connection. The top part 1*a* also defines a hopper 2 for loading the material to be crushed.

Inside the cited shroud 1, there is provided a shaft 3, in proximity to the top end whereof a ball swivel joint 4 is provided which is accommodated in a mating seat or socket provided in the top part 1*a*.

At a middle portion of said shaft 3, there is provided a crushing or milling cone 5, the connection whereof to the shaft will be described hereinafter, the crushing cone having its major base facing downwards; at said crushing cone 5, on the part 1*a* of the shroud 1, there is provided a conical ring 6 which has a smaller taper than the crushing cone 5, thereby a space or clearance is established at 7 which widens out towards the top part and assists in conveying the material to be crushed from the hopper 2 downwards.

The peculiar feature of the invention is that it provides a bushing 10 set for rotation about its own axis and defining on its inside an eccentrical cavity 11, accommodating a hydraulic piston 12 in sealed relationship.

More specifically, the bushing 10, which has a pulley 13 at its lower portion for connection to a belt drive which transmits the rotary motion, is supported on the part 1*b* of the shroud 1 through a first tapered roller bearing, indicated at 14, which is capable of withstanding both the axial thrust imparted by the shaft and the radial thrust transmitted by the eccentricity; the first tapered roller bearing may, however, be replaced with a radial bearing and an axial bearing, in combination.

The eccentrical motion is transmitted to the bottom end of the shaft 3, received in the eccentrical cavity 11 through a tilting roller bearing 15 having on its inside a bushing 16 made of an antifriction material, which bushing allows for the axial displacement of the shaft, as will be explained hereinafter, the bearing being mounted on the inside walls of the eccentrical cavity 11.

The shaft 3 rests with its bottom end on the cited hydraulic piston 12, with the interposition of an axial roller bearing, indicated at 17.

An essential feature is that the shaft 3 is arranged concentrically with respect to the piston 12 which is moved of eccentrical motion, thereby the axial roller bearing 17, which bears the axial thrust of the shaft 3, is as far as possible free of rubbing actions and overheating, such as would be unavoidable with a traditional fixed hydraulic piston system.

In fact, with the cone crusher according to this invention, the piston 12 is rotated eccentrically owing to the bushing 10, which is formed with the cited eccentrical cavity 11 accommodating the piston, rotating about its own axis.

Into the chamber 12*a* which is defined in the eccentrical cavity 11 below the piston 12 by the closed bottom of the cavity 11, there is fed pressurized oil from a hydraulic system which will be described hereinafter.

In the cited chamber 12*a*, there is provided a body 20 of an elastic material which is resistant both to oil and continued and sudden changes of dimension and has the function of dampening the shocks transmitted by the crushing chamber owing to the unavoidably severe and discontinuous nature of its work. By contracting its own volume under these shocks, the body 20 is effective to reduce or absorb the hammer shocks, thus protecting the bearings as well as the hydraulic system and the structure.

To introduce pressurized oil into the chamber 12*a* defined within the eccentrical cavity 11, a rotary joint is required effective to withstand high rates of rotary sliding movement and severe pressure shocks.

Figure 2:
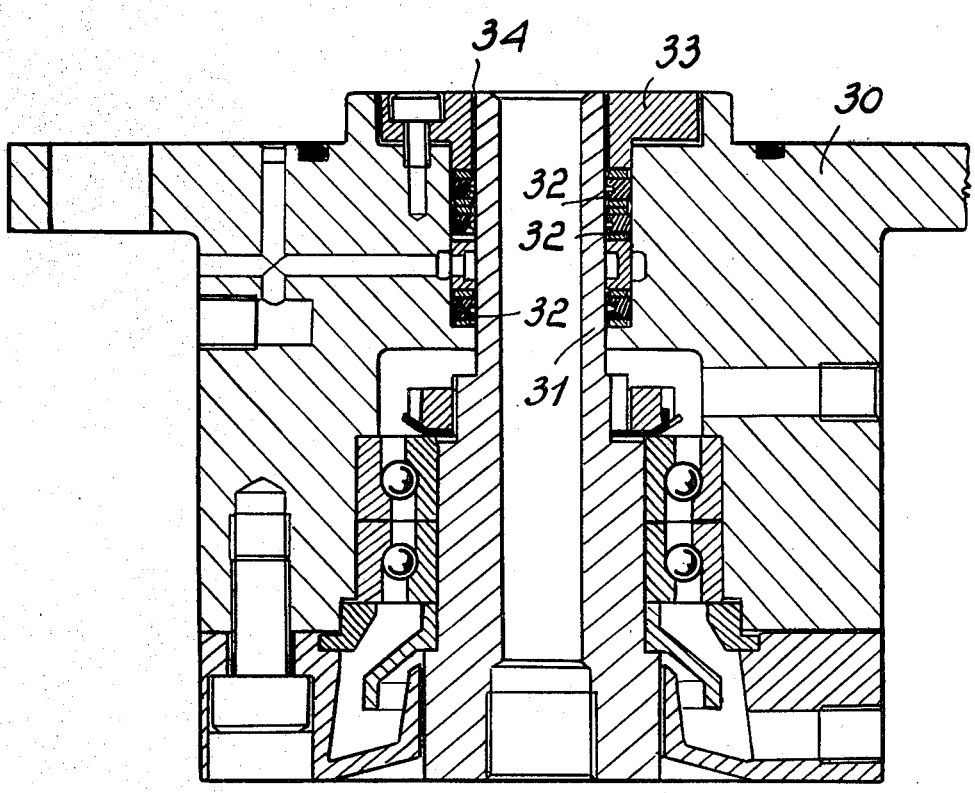
FIG. 2 is an enlarged scale detail view of the rotary joint provided for the hydraulic system.
Figure 3:
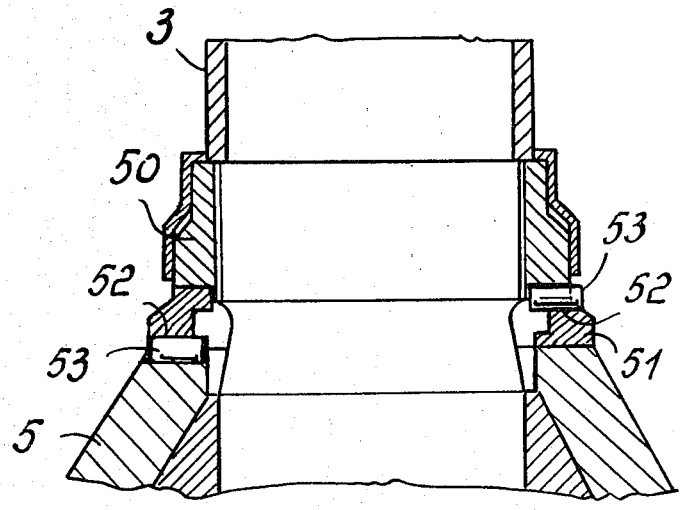
FIG. 3 shows, on an enlarged scale, the connection between the clamping nut and crushing or milling cone.

Such a joint, as illustrated in FIG. 2, has a mounting flange 30 for attachment to the bottom of the chamber 12*a*, inside which a passageway is defined for the fixed channel, as indicated at 31.

Between said fixed channel 31 and the seat specially provided in the flange, there are interposed rotary seals 32, of a type known per se; furthermore, and here resides an essential aspect of the invention, at the ends of the channel 31, proximate to the chamber 12*a*, a small plate 33 is provided which closely surrounds, without actually contacting it, the channel 31, in such a manner as to leave an extremely reduced clearance 34 for the oil to pass therethrough. Thus, any overpressure which might build up inside the chamber 12*a* cannot discharge itself freely against the rotary seals, which would be quickly damaged, and the oil can be simply bled off between the small annular slit 34 defined between the plate 33 and channel 31, thereby the seals will be adequately protected.

Moreover, the seals may be two or three in number, such that all of them contribute to the sealing action, and an adequate lubrication is provided to prevent the seals from drying in time and losing their inherent elastic and sealing properties.

The cone crusher according to the invention further comprises a hydraulic control for the axial displacement of the shaft, that is for adjusting the gap between the crushing cone and ring. This is accomplished through the provision of a cylinder-piston unit, indicated at 40, the rod 41 whereof is interposed between the cylinder-piston and the top end of the shaft 3. The fluid, through a line 42, is taken out of the machine, where another hydraulic apparatus, indicated at 43 and known per se, measures the increase or decrease of the amount of liquid displaced by the piston 40 and accordingly the amount of displacement of the shaft 3 in one or the other direction; this enbales the machine to be remote controlled, if desired.

A further peculiar feature of the invention resides then in the means for securing the crushing cone 5.

The crushing cone 5, as usual with the machines in question, must be replaced when worn out, and therefore, it used to be supported in general by a conical support and clamped by means of a nut provided with threads such that the nut was in practice run and set by rotation of the shaft 3.

This resulted in the clamping or retaining nut, whenever the crushing cone had to be replaced, being overtightened onto the crushing cone, such that the nut had to be cut because it could not be removed, not even with mechanical aids. In many cases, this resulted in the shaft becoming damaged, since it was difficult to cut the nut without affecting the shaft at the same time.

To eliminate such drawbacks, in the cone crusher of this invention, between the crushing cone 5 and retaining or clamping nut 50, there is interposed a hollowed ring 51 which is provided, at the top and bottom, with notches or recesses 52 whereinto pawls 53 are inserted which accomplish the rotary connection between the nut and crushing cone, which allows the crushing cone to be clamped in a quite conventional manner.

Said hollowed ring 51, however, is first of all spaced apart from the shaft 3 and made of a material which makes the cutting of the ring much easier, such that when the crushing cone must be replaced it is sufficient to cut the ring to practically break the tight connection between the nut and crushing cone, thereby, once the ring has been removed, the nut can be easily threaded out and the crushing cone 5 replaced.

As can be seen, therefore, the invention provides an intervening element, represented by the ring 51, which can be removed or suitably shaped for an easy cutting thereof and facilitated disassembly procedures.

The cone crusher of this invention operates in practice in a similar manner to known crushers of this type; in fact, once the gap or clearance has been adjusted by repositioning the shaft axially, the crushing or milling operation is initiated by controlling the bushing 10 to rotate, which bushing, through its eccentrical cavity 11, will transmit the desired conical swinging motion to the shaft which, by rotating concentrically to the hydraulic piston 12, is not subjected to rapid wear or excessive overheating.

Moreover, and similarly to conventional crushers, in the oil supply system, there is provided an expansion box indicated at 60, having the function of damping any hydraulic hammer shocks that might propagate through the oil line.

The introduction of pressurized oil into the chamber 12 further enables the shaft 3 to be positioned at will in height, which adjustment can also be remotely controlled by virtue of the cylinder-piston 40 acting also as a sensor at the top end of the shaft.

The invention as described is susceptible to many modifications and variations within the scope of the instant inventive concept.

Optionally, a pin may be provided which extends rigidly with and concentrically to the piston 12; with said pin there would engage a radial bearing acting on the inner wall of the piston to damp any radial efforts developed by the bushing 16 wear. Furthermore, a seating support of an antifriction material is provided between the bottom end of the shaft 3 and the bearing 17.

Furthermore, all of the details may be replaced by other technically equivalent elements.

I claim:

1. A cone crusher for crushing stones and the like, comprising an outer shroud enclosing a space, a substantially vertical shaft within said space and driven with a conical swinging motion, said shaft having a downwardly diverging crushing cone at a middle portion thereof, on said shroud a conical ring spacingly arranged around said crushing cone and having a smaller taper than said crushing cone to define an upwardly widening space therebetween, a rotatory bushing member surrounding said shaft below said crushing cone and rotatably supported on said outer shroud, said bushing member having a circular outer periphery defining an axis of rotation and a cylindrical inner cavity having an axis eccentric with respect to said axis of rotation, said cavity receiving a lower end portion of said shaft and having a closed bottom, a piston axially slidable within said inner cavity and arranged below said shaft, bearing means between said shaft and said piston for rotatably supporting said shaft on said piston on one side thereof facing said shaft, said piston having another side thereof opposite to said one side and forming a cylinder chamber with said closed bottom, a hydraulic system for supplying pressure fluid into said cylinder chamber thereby to hydraulically support said piston and said shaft thereon, transmission means on said rotary bushing member for imparting rotation thereto thereby to impart rotation to said bushing member about said axis of rotation thereof and to impart an eccentric rotatory movement to said piston and said shaft thereon, said hydraulic system including a rotary joint connected to said rotary bushing member, said rotary joint having a mounting flange for connection to said closed bottom of said cavity, a fixed channel extending through said mounting flange for the passage of pressure fluid from said hydraulic system into said cylinder chamber of said cavity, a seat in said mounting flange, rotary seals in said seats and interposed between said fixed channel and said mounting flange, a plate member surrounding said fixed channel and providing a clearance therebetween for bleeding off pressure fluid therethrough.

* * * * *